US010912711B2

(12) United States Patent
Luong et al.

(10) Patent No.: US 10,912,711 B2
(45) Date of Patent: Feb. 9, 2021

(54) HEATING DEVICE AND SYSTEM FOR A WATER BASIN

(71) Applicant: Lexor, Inc., Westminster, CA (US)

(72) Inventors: Christopher Luong, Westminster, CA (US); Quang Nguyen, Irvine, CA (US); Thuong Pham, Long Hao Commune (VN)

(73) Assignee: Lexor, Inc., Westminster, CA (US)

( * ) Notice: Subject to any disclaimer, the term of this patent is extended or adjusted under 35 U.S.C. 154(b) by 24 days.

(21) Appl. No.: 16/468,664

(22) PCT Filed: Jan. 9, 2018

(86) PCT No.: PCT/US2018/013000
§ 371 (c)(1),
(2) Date: Jun. 11, 2019

(87) PCT Pub. No.: WO2018/129542
PCT Pub. Date: Jul. 12, 2018

(65) Prior Publication Data

US 2019/0328612 A1 Oct. 31, 2019

Related U.S. Application Data

(60) Provisional application No. 62/443,951, filed on Jan. 9, 2017.

(51) Int. Cl.

| | |
|---|---|
| ***A61H 35/00*** | (2006.01) |
| ***A61H 33/00*** | (2006.01) |
| *A47C 1/04* | (2006.01) |

(52) U.S. Cl.
CPC ..... *A61H 35/006* (2013.01); *A61H 33/0087* (2013.01); *A61H 33/0095* (2013.01);
(Continued)

(58) Field of Classification Search
CPC ..... A61H 35/006; A61H 33/0087; A61H 33/0095; A61H 33/6005; A61H 33/6026
(Continued)

(56) References Cited

U.S. PATENT DOCUMENTS

2004/0006289 A1 1/2004 Liao
2006/0195979 A1* 9/2006 Liu ..... A61H 35/00 4/535

(Continued)

FOREIGN PATENT DOCUMENTS

CN 101852484 A 10/2010
CN 203634061 U 6/2014

OTHER PUBLICATIONS

International Search Report and Written Opinion on corresponding PCT application (PCT/US2018/013000) from International Searching Authority (US) dated Mar. 20, 2018.

*Primary Examiner* — Huyen D Le
(74) *Attorney, Agent, or Firm* — Klein, O'Neill & Singh, LLP

(57) ABSTRACT

An induction heating system for a basin of a pedicure chair and a pedicure chair with one or more pumps and one or more heating sources are disclosed. A conducting object is located on an interior side of a first wall of the basin, with an induction heater located on the exterior side of the first wall. The conducting object is separated from the induction heater by a solid portion of the first wall. The induction heater is configured to generate a high frequency field that passes through the solid portion of the first wall and causes the conducting object to generate heat. A controller is configured to turn on/off the induction heater to maintain a desired temperature in the basin.

20 Claims, 5 Drawing Sheets

(52) U.S. Cl.
CPC ..... *A61H 33/6005* (2013.01); *A61H 33/6026* (2013.01); *A47C 1/04* (2013.01); *A61H 2033/0054* (2013.01); *A61H 2201/0149* (2013.01); *A61H 2201/0207* (2013.01); *A61H 2201/0228* (2013.01); *A61H 2201/1207* (2013.01); *A61H 2201/164* (2013.01); *A61H 2201/5025* (2013.01); *A61H 2201/5038* (2013.01); *A61H 2201/5043* (2013.01); *A61H 2201/5082* (2013.01); *A61H 2203/0431* (2013.01); *A61H 2205/12* (2013.01)

(58) Field of Classification Search
USPC ..... 4/622
See application file for complete search history.

(56) References Cited

U.S. PATENT DOCUMENTS

| | | | | |
|---|---|---|---|---|
| 2011/0004994 | A1 | 1/2011 | Le et al. | |
| 2014/0059759 | A1* | 3/2014 | DuHack ..... | A61H 33/0095 4/494 |
| 2014/0150176 | A1* | 6/2014 | Tran ..... | A61H 33/0087 4/622 |
| 2015/0040310 | A1 | 2/2015 | Long | |

* cited by examiner

HEATING DEVICE AND SYSTEM FOR A WATER BASIN

FIELD OF ART

The present disclosure is directed to apparatuses and methods for a pedicure chair with a basin and more particularly to pedicure chairs having water jet mechanisms and a heat source for heating water that is circulated in the basin and related methods.

BACKGROUND

Certain types of pedicure chairs have a pipe system to introduce water into, and remove water from, the chair's basin. The water is circulated by a conventional motor-driven, shaft mounted, impeller. There is frequently water leakage around the shaft requiring maintenance. Magnetic pumps are also now available that omit direct shaft connection with the impeller. Also, the pipe system is subject to accumulation of dirt, mold and bacteria and is very difficult to clean and sterilize after use by customers. If not properly sanitized, there is the possibility of health concerns, safety and anxiety of customers.

SUMMARY

An induction heating system a pedicure chair, comprising: a basin having at least a first wall; a conducting object located on an interior side of the first wall of the basin; an induction heater located an exterior side of the first wall of the basin; and a controller configured to turn on or off the induction heater; wherein the conducting object is separated from the induction heater by a solid portion of the first wall; wherein the induction heater is configured to generate a high frequency field that passes through the solid portion of the first wall and causes the conducting object to generate heat.

The induction heater can comprise an electromagnet coil and an electronic oscillator.

The conduction object can be an iron plate.

The induction heating system can further include a heat-resistant cover mounted over the conducting object.

The cover over the conducting object can comprise one or more openings for water to flow through.

The induction heating system can include a capacitive sensor. The sensor can be used use to detect the fill level of the water in the basin, which could then trigger or prevent operation of the circulating pump.

The induction heating system can include a controller and the controller can be configured to turn on a circulating pump based at least partly on a water level detected by the capacitive sensor.

The induction heating system can further comprise a temperature sensor.

The controller can be configured to turn on the induction heater based at least partly on the temperature sensor.

A pedicure chair with water circulation comprising: a basin comprising an exterior surface and an interior surface for holding water, the basin having at least a first wall; at least one pump coupled to the basin, wherein the motor is disposed on the exterior surface of the basin and the cover is disposed on the interior surface of the basin; a conducting object located on an interior surface of the first wall of the basin; an induction heater located on an exterior surface of the first wall of the basin; and a controller configured to turn on or off the induction heater; wherein the conducting object is separated from the induction heater by a solid portion of the first wall; wherein the induction heater is configured to generate a high frequency field that passes through the solid portion of the first wall and causes the conducting object to generate heat.

The induction heater with the pedicure chair can comprise an electromagnet coil and an electronic oscillator.

The conduction object with the pedicure chair can be an iron plate.

A heat-resistant cover can be mounted over the conducting object located with the pedicure chair.

The cover can comprise one or more openings for water to flow through.

A method for mounting an induction heating system to a pedicure chair, the method comprising: attaching a conducting object to an interior surface of a first wall of a basin; attaching an induction heater to the exterior surface of the first wall; and electronically connecting the induction heater to a controller configured to turn on or off the induction heater; wherein the conducting object is separated from the induction heater by a solid portion of the first wall.

A method of making and using a pedicure chair as described and shown herein.

A further aspect includes an induction heating system for a pedicure chair, comprising: a basin having a plurality of walls defining a basin interior, said plurality of walls comprising a first wall having a first wall exterior and a first wall interior; a conducting object located in the basin interior; an induction heater located externally of the basin interior; and a controller configured to turn on or off the induction heater; wherein the conducting object is separated from the induction heater by a solid portion of the first wall; wherein the induction heater is configured to generate a high frequency field that passes through the solid portion of the first wall to cause the conducting object to generate heat.

Another aspect of the present invention can include a pedicure chair comprising: a basin comprising an exterior surface and an interior surface defining a basin interior for holding water, the basin having a first wall; a pump comprising a motor and a cover coupled to the basin, wherein the motor is disposed on the exterior surface of the basin and the cover is disposed on the interior surface of the basin; a conducting object located in the basin interior; an induction heater located externally of the basin interior; and a controller electrically coupled to the induction heater and configured to turn on or off the induction heater; wherein the conducting object is separated from the induction heater by a solid portion of the first wall; wherein the induction heater is configured to generate a high frequency field that passes through the solid portion of the first wall and to cause the conducting object to generate heat.

Aspects of the present invention includes a method for mounting an induction heating system to a pedicure chair, the method comprising: attaching a conducting object to a basin interior of a basin, said basin comprising a first wall; attaching an induction heater externally of the basin interior; and electronically connecting the induction heater to a controller, said controller configured to turn on or off the induction heater; wherein the conducting object is separated from the induction heater by a solid portion of the first wall.

The method can further comprise sending a temperature signal to the controller to turn on the induction heater.

The present invention comprises a pedicure chair comprising a basin for holding a water bath. The pedicure chair can include a seat for a user to seat on.

The basin can be sized and shaped to receive and bathe the user's feet. Water can be circulated in the basin by one or more circulating pumps located behind the chair cover or chair body and out through covers or nozzles that may be adjustable to direct the flow of water, such as to flow at or towards the person's feet.

The basin can be mounted with one or more pumps, each with a cover having inlet and outlet nozzles. In some examples, each circulating pump can have its pump cavity, including the pump cover and the pump impeller, located inside the interior of the basin and the driving end, such as the motor, located external of the basin for driving the impeller. For example, the impeller on the inside of the basin can be rotated magnetically from a magnetic drive motor located externally of the basin.

In other examples, the impeller is directly driven by a drive shaft. In some examples, one or more removable panels are provided with the chair housing to provide access to the one or more circulating pumps disposed under the seat of the chair, such as for maintenance and repairs.

An induction heating system can be incorporated with the pedicure chair to allow water in the basin to be warmed and for heating to be carried out without providing a hole or opening through the basin wall to mount the heating element or object.

As the pedicure chair of the present embodiment uses induction heating, a through hole through the wall of the basin to mount the heating element can be omitted. In an example, induction heating from a heat source can be located externally of the basin and heat a conduction object inside the basin, such as the basin interior.

Optionally, a passage or opening can be provided through the wall of the basin to enable direct contact between the heat source and the conduction object with provisions for sealing the passage from leakage.

However, by omitting a passage or opening between the heat source and the conduction object, the chance of water leakage from the basin is reduced. Further, the structural integrity of the chair is increased with fewer through holes or through passages formed through the wall of the basin and the chair body.

The induction heating system or heating source allows the water inside the basin to be heated and maintained at a desired temperature range to provide the user with a better experience than chairs without a similar heating source. In addition, the present induction heating system can heat the pedicure bath without a passage or opening through the wall of the basin between the heat source and the induction object or workpiece. The present induction heating system can also provide heat to the pedicure bath without direct contact between the heat source and the induction object.

The induction object located inside the basin can heat water coming in contact with it from a first temperature and elevate the water to a second higher temperature, such as from T1 to T2 and wherein T2 is higher than T1.

The heating source located external to the basin can comprise an inductor, which can be one or more copper coils, that is energized with AC current. Alternating current flowing through the inductor generates a magnetic field. The strength of the field varies in relation to the strength of the current passing through the coil such that heat can be controlled by controlling the current passing through the inductor. The field is concentrated in the area enclosed by the coil or adjacent by coil. The magnitude of the field can depend on the strength of the current and the number of turns in the coil. Concurrently therewith, the water can be circulated in the basin by the one or more circulating pumps.

Water can be added to the basin manually or by an automatic fill system.

The pedicure chair can include a temperature selector and a display for monitoring the temperature of the water in the basin. Other switches or control mechanisms may be included, such as an on/off button and switches for controlling other functions incorporated with the chair, such as to controlling moving message elements. The temperature selector may be a simple potentiometer for raising or lowering water temperature or may be a more complicated controller that allows programming and automated adjustments of water temperature, such as to elevate the temperature for 20 minutes then cool down for 5 minutes then cycle back up, etc.

A display may be selectable to display various parameters such as actual water temperature, desired water temperature, elapsed time that the person has immersed their feet in the basin, total time, or other parameters. In another example, a second control and display panel can be provided nearer the basin and further away from the user or customer of the pedicure chair to permit the technician or worker to control the water temperature and other parameters. The second control and display panel may include a temperature selector, a display switch, an on/off switch, and an emergency override, as non-limiting examples.

A predetermined amount of water can be placed in the basin and the water circulated within the basin by the one or more circulating pumps. The water can be heated to the desired temperature by means of the temperature selector, which can increase or decrease the current to the inductor to increase or decrease the magnetic field and hence the eddy currents and hysteresis to the workpiece located in the basin that the circulated water comes in contact with to thereby control the water temperature.

Additional substances such as conditioners, medicaments, fragrances, etc., may be placed in the basin with the heated water for a holistic experience.

A customer seated in the pedicure chair with his feet submerged in the circulating heated water may adjust the water temperature accordingly by the temperature selector. The basin can be emptied of water using existing means after the pedicure procedure is completed and the customer exits the chair. Then, the basin and portions of the jet pump that come in contact with the heated water can be sanitized in preparation for the next customer.

For example, a new bath with a cleaner or disinfectant may be circulated through the basin to sanitize the chair for the next customer. In some examples, a thermoplastic liner may be used to line the basin. The liner can be replaced when a new or different user uses the chair. Water can be added directly into the basin with the liner in place. The pump head, impeller, and pump cover can be placed over the liner and be driven magnetically via a magnetic drive motor.

In an example, the heating system can comprise parts located both inside the basin, such as in the basin interior, and outside the basin. For discussion purposes, the inside of the basin is called the interior space or basin interior and the outside of the basin is called the exterior space, or externally of the basin interior.

On the outside of the basin or exterior space can be an induction heater comprising an inductor, which can be one or more copper coils, and an electronic oscillator, such a solid state RF power supply that sends AC current through the inductor. On the inside of the basin or interior space can be a conducting object or workpiece such as an iron plate, steel plate, or other metal object capable of being heated by induction.

In practice, the workpiece may be secured to the wall of the basin, such as a first wall, using fasteners, and a protective cover, such as a non-conducting insulator, covering the workpiece to avoid direct contact with the workpiece by the customer for the customer's safety. The wall structure, such as a portion of the first wall, can be located between the workpiece and the copper coil.

Some embodiments may use multiple of the elements described herein for the heating system in order to increase the heating speed of water in the basin. For example, there may be a first conducting object and a first induction heater on a first wall section of the basin, with a second conducting object and a second induction heater on a second wall section of the basin.

By using multiple heating elements and/or spreading out the heating elements, the water can be heated by multiple sources to more quickly come up to a uniform temperature. Other embodiments may use different variations, such as having an extended size conducting object along one basin wall, with a first induction heater near one end with a second induction heater near the opposite end.

When in service, the oscillator passes a high-frequency alternating current (AC) through the conductor to generate a high frequency field. When the rapidly alternating high frequency field penetrates the conducting object, it generates electric currents inside the object. This current is called Eddy currents (also called a Foucault current). The Eddy currents cause the magnetic domains within the workpiece to constantly flip and cause considerable friction and heating. This type of heating is known as hysteresis.

When the Eddy currents flow through the small resistance of the metal object, it heats it up by Joule heating, making the metal object rapidly generate heat inside itself. The amount of heat generated depends on the size and turns of the electromagnetic copper coil, the frequency of the electromagnetic induction, and the electric current. The frequency of the current used depends on the object size, material type, coupling (between the work coil and the object to be heated) and the penetration depth. In ferromagnetic (and ferrimagnetic) materials like iron, heat may also be generated by magnetic hysteresis losses.

Typically, the basin can be made of a non-conducting material, such as plastic or composite or combinations thereof, so the high frequency field can pass through the basin material with little effect to the basin. The field can then reach the conducting object and cause it to heat up through high frequency electromagnetic induction. The conducting object can then heat the water in the basin that comes into contact with it. The one or more circulating pumps used to circulate water in the basin can then circulate the heated water in the basin so that the water becomes more uniformly heated.

Beneficially, as the basin's structure does not need to be compromised for heating purposes (e.g., by drilling a hole or otherwise creating an opening in the basin wall to directly connect the workpiece with a heating source or power source), leaks are more easily prevented. Openings may be created in the basin wall for other reasons, such as for the circulating pump or the nozzles or not at all if using one or more magnetic pumps. However, reducing the number of openings in the basin wall can reduce the possibility of leaks and the structural integrity of the basin.

In an example, the conducting object or workpiece can be attached to an interior surface or first wall section of the wall of the basin. The conducting object may be attached to the basin via a variety of mechanisms, such as screws, adhesive, a built-in receptacle in the basin wall, clamping tabs projecting from the basin wall, and/or the like.

A cover, which can be plastic, silicone, rubber or another heat-resistant material, can be placed on top of the conducting object, such as on the other side of the workpiece opposite the first wall, to prevent a user of the pedicure chair from coming into direct contact with the conducting object for safety concerns. When the conducting object is heated, the plastic cover can act as an insulator and protects the user.

In some embodiments, the plastic cover can comprise one or more holes, cutouts, or other types of openings to allow water to more easily flow through the cover and into contact with the conduction object to be heated. A gap can be provided between the cover and the workpiece to minimize the amount of heat transferred to the cover by the workpiece via direct contact. In operation, the circulating pump creates a water current in the basin that moves water in the basin through the openings of the cover and the gap and past the conduction object, allowing that water to be heated.

In the illustrated embodiment, a disk winding, conductor, or electromagnetic coil and a second cover are mounted on the exterior surface of the basin wall. As discussed above, the copper coil can generate a high frequency magnetic field to heat the conducting object in the interior space of the basin, on the other side of the first wall section. The second cover can be plastic, silicone or other material. The second cover may be used to insulate or isolate the conductor from other components of the pedicure chair.

The electromagnetic coil can be connected (e.g., by wire) to a magnetic inductance heat generator, which can comprise a power amplifier and an electronic oscillator. Operating together, the electromagnetic coil and the heat generator can function as the heat source for heating the workpiece inside the basin. The heat generator can be connected to a controller.

The controller may be a simple combinational/sequential logic device or may be a more complicated microprocessor based circuit. Other components can also be connected to the controller, such as a temperature sensor, a display, and a capacitive sensor.

The capacitive sensor can be attached to the interior surface of the first wall section of the basin or elsewhere on the interior of the basin. The sensor can be connected to the controller by a wire running through or over the first wall. The controller can then receive sensor data from the capacitive sensor, which data may be used to determine when to turn on/off the induction heating system and/or the circulating pump. For example, the capacitive sensor can be used to detect the fill level of the water in the basin, which could then trigger or prevent operation of the circulating pump 100.

In one embodiment, a temperature selector, which may be a simple potentiometer, or may be a more complicated panel having switches for both automatic and manual temperature control, is also connected to the controller. The controller can receive input from the temperature selector as well as status data for the pump (e.g., whether the pump has been activated or not). Based on these parameters, the controller can send the appropriate electrical signals to the heating generator in order to control the magnitude of the electric field to control the inductive heat in the workpiece to then control the temperature of the water.

The temperature sensor can be disposed in the basin and feeds actual water temperature back to the controller. The controller can then adjust the electrical current to the heating element to either maintain or change the temperature of the water. The controller can also send information to the display so that parameters such as selected water temperature, or set point, and/or actual water temperature may be viewed. The controller may also have an internal clock to display elapsed time that the jet pumps have been activated for a particular customer.

An audible generator may be included to notify the technician of various signals or indicators, such as when the temperature reaches a certain point, when a treatment session terminates, etc.

The heating system of the present invention can operate using a various different control schemes. The capacitive sensor can first determine whether the water in the basin is above a predetermined threshold level. If not, the capacitive sensor can repeat checking the level and the process proceeds back to the beginning. Checks may happen periodically or continuously.

If the water level is above the threshold, the process can proceed to the next step. The controller can turn off an optional solenoid valve. In one embodiment, the solenoid valve opens/closes a flow line to the basin, such as for water feed to the basin. For example, once the water flowing from an outlet port reaches a certain threshold level and triggers the capacitive sensor, the solenoid valve can close the outlet port to prevent additional water from coming in and prevent water in the basin from coming out. The controller can also turn on a motor of the circulation pump, such as an Ecojet™ magnetic motor, to circulate the water in the basin. Alternatively, the controller sends a signal to the display to ask that additional water be added before the system proceeds if no automatic fill is available.

Next, the temperature sensor can determine the temperate of the water. Based on a selected threshold, such as an exemplary 104° F., the controller turns on/off the induction heating system or, specifically, a component of the system such as the power amplifier/magnetic inductance heat generator. For example, assuming a threshold or set point of 104° F., if the actual water temperature is below 104° F., the process proceeds to the next step and if equal or higher, proceeds to a different step. Other temperature thresholds or set points may also be used and the temperature threshold may even be set or controllable by the user.

The controller can turn on the induction heating system (or component of the system) in order to heat the water in the basin. For example, the controller may turn on the system in 30 second increments and then proceed back to check the temperature again. Other time intervals may also be used, such as 15, 20, 45, 60 seconds, or more. In yet other examples, the controller turns on the system for an extended period and controls the temperature by controlling the current in the inductor.

The controller can turn off the induction heating system (or component of the system) for a certain interval, such as 30 seconds or the other intervals described above. The process then proceeds back to the beginning to check the temperature again. By looping back to the earlier steps, the controller can maintain the temperature in the basin at the desired temperature.

The described process is exemplary only and that the controller may be programmed to carry out different tasks and steps. Thus, other variations are possible and contemplated. For example, the steps may occur in a different order. In addition, different trigger points may be used for the decision points, such as higher or lower water levels or higher or lower temperatures.

Other embodiments may use a simplified process without using input from a capacitive sensor. Other embodiments may use more complex processes, such as requiring input from a user to set the target water level, the target temperature, and/or the polling frequency (e.g. 30 seconds) of the temperature sensor for maintaining the water temperature.

A pump in accordance with aspects of the present invention can include a pump housing having a generally cylindrical shape having external threads formed thereon. The pump housing may be formed with two separate housing elements or components and is connected to the motor casing to form an exemplary circulating pump in accordance with aspects of the present devices, systems and methods.

A first or outer housing element of the pump housing can be threadedly or rotatably coupled to the elongated end of the second or inner housing element. The axial position of the first housing element may be adjusted relative to the second housing element by rotating the two components relative to one another. Assembly bolts may be used to bolt the first housing element to the mounting bracket mounted to the motor casing to connect the pump housing to the motor casing.

Alternatively, the first housing element may attach to the mounting bracket on the motor casing using reversible detents. In accordance with aspects of the present devices, systems and methods, the second housing element has an integrally formed mounting shoulder, which may instead be separately formed and subsequently coupled to the cylindrical section of the second housing element.

The gap between the first housing element, which may be referred to as an adjustable mounting flange, and the mounting shoulder may be adjustable to receive different wall thicknesses therebetween, such as different basin wall thicknesses. Internally, the second housing component can have an integrally formed base wall having a shaft opening for receiving a drive shaft. The base wall is preferably integrally formed with the threaded cylindrical section, such as by casting or molding depending on the material used to form the pump housing.

In another embodiment, the base wall is separately formed at subsequently attached to the cylindrical section. In some examples, the circulation pump can a magnetic pump, such as an Ecojet Magnetic Drive pump, and the impeller is rotated by a magnetic drive without directly driving the impeller with a drive shaft. For example, the cover and a front housing can contain an impeller in a front drive end. The front drive end can be positioned inside the basin while the electric motor is mounted externally of the basin. When the rotor of the electric motor rotates, it rotates the impeller inside the front drive end located inside the basin.

The pump housing may be installed to the basin by placing the second housing element through an opening in the basin and then tightening the first housing element towards the mounting shoulder with the wall surface of the basin located therebetween. The cover can then engage the mounting shoulder, such as by engaging removable detents on the cover and on the mounting shoulder of the housing, to cover the internal pump components, such as the impeller. Internally, where the drive shaft of the motor rotates and connects to an impeller, a stuffing box equipped with packing materials or a mechanical seal is provided to seal against water leakage via the shaft and into the motor working components, such as to the rotor and stator. Where the circulating pump is a magnetic drive pump, there is no shaft from the motor connecting the impeller.

The cover can have one or more intake ports or inlet openings, herein inlet or intake port, and one or more outlet ports, herein outlet or outlet port. In general, water from the basin enters the circulating pump via the intake port, is circulated within the housing, such as in the volute section of the housing by an impeller, and exits the circulating pump via the outlet port. In some examples, the outlet port is pivotable or maneuverable, such as with a ball and socket joint, relative to the cover surface to allow directional control of the outlet from the pump.

In an alternative embodiment, the electric motor may be an induction motor that has an electrically activated stator and a permanent magnet rotor. In a preferred embodiment, the stator has a well formed therein, the opening of the well being oriented toward the basin. The rotor has a semi-spherical shape which is received in the well in the stator. The rotor may have a central bore thereon and the well may have a post formed centrally therein such that the rotor is always properly seated in the well. The rotor preferably has a plurality of vanes formed circumferentially therein.

When operational, the motor turns an impeller to create a vacuum at the inlet to draw in water. The motor can turn in either a clockwise or counter clockwise manner. Water within the basin is drawn into the intake opening located generally in the center of the circulating pump cover by rotation of the impeller. When discharging, the outlet ports act as a nozzle to forcefully direct the water into the basin producing agitation, circulation, and a whirlpool effect of the water within the basin.

Thus, an aspect of the present disclosure may be understood to include devices, systems, and methods comprising an induction heating system sized and shaped for use with a pedicure chair, such as for mounting to wall surface(s) of a basin of the pedicure chair. Another aspect of the present disclosure is a combination pedicure chair comprising a basin having an induction system mounted thereto. The pedicure chair can further include one or more circulation pumps.

A further aspect of the present disclosure is a method for heating water in a pedicure chair. In one example, the method comprises attaching an induction heater to the exterior of a basin of the pedicure chair and a conduction object to the interior of the pedicure chair, with the induction heater and the conduction object separated by a solid portion of the basin wall. A controller connected to the induction heater is configured to turn on/off the induction heater based on various data inputs, such as temperature and/or water fill level, in order to maintain the temperature in the basin at a desired temperature.

Methods of using and of making the pedicure chair and components thereof, including the heating system, are within the scope of the present invention.

BRIEF DESCRIPTION OF THE DRAWINGS

These and other features and advantages of the present devices, systems, and methods will become appreciated as the same become better understood with reference to the specification, claims and appended drawings wherein:

DETAILED DESCRIPTION

Figure 1:
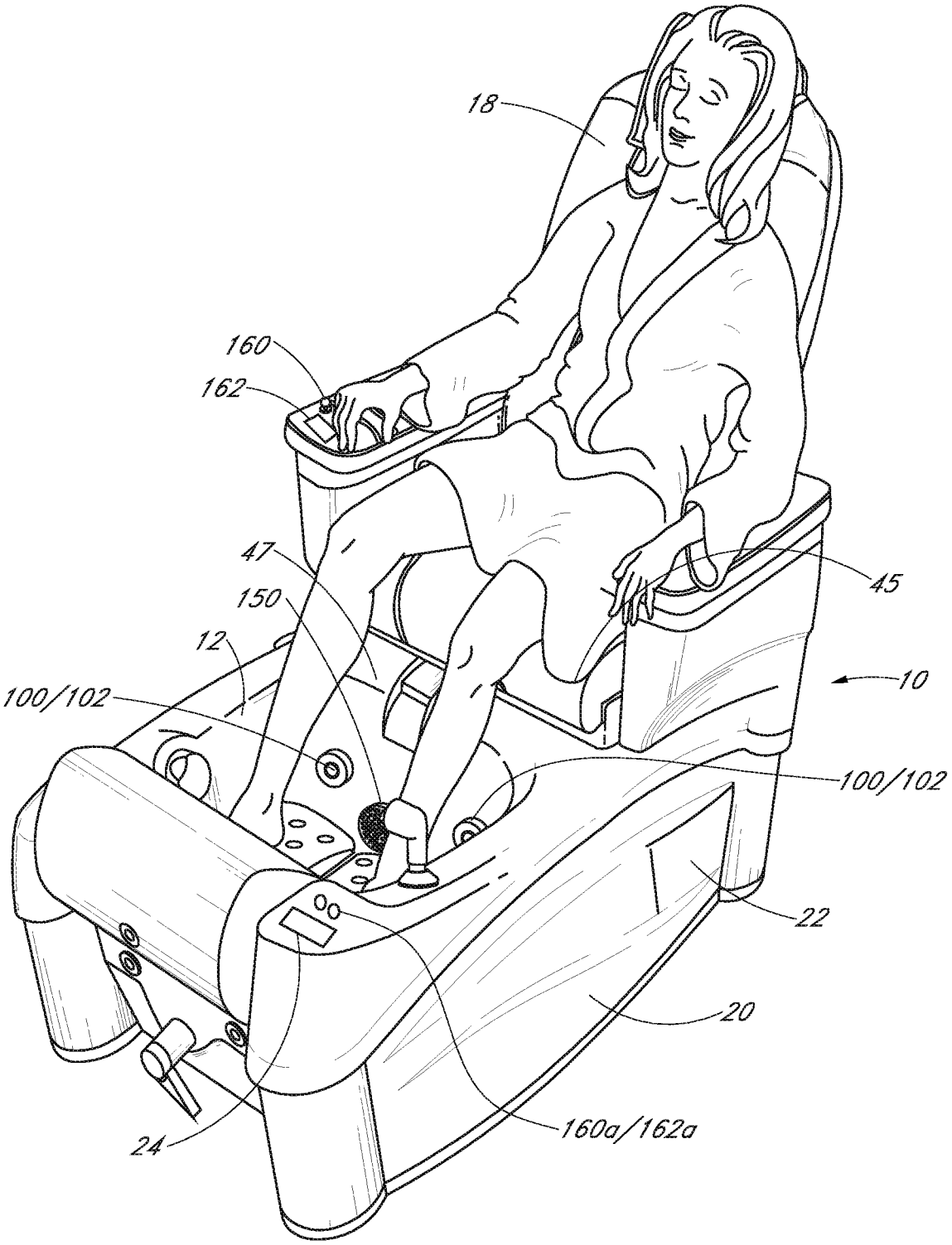
FIG. 1 illustrates a perspective view of a pedicure chair with one or more circulating pumps, and one or more heating sources according to one embodiment of the present disclosure.

There is a need for a circulating system for water in a pedicure bath in a pedicure basin that provides temperature controlled heated water, adequate circulation of the water, that can be cleaned and sterilized rapidly and effectively, and combinations thereof. Furthermore, the pedicure bath preferably contains the heated water with a low possibility of leaks and maintenance requirements. One way to reduce the likelihood of leaks is to maintain the integrity of the basin structure that holds the water by reducing the number of components that project through the walls of the basin. By reducing openings in the walls of the basin, there is less of a need for valves and/or seals that have a chance to fail and create leaks. The disclosure below discusses embodiments of an induction heating system that uses a conduction object, such as a workpiece to be induced by eddy currents and hysteresis to rise in temperature, in the basin interior and an induction heater at the basin exterior to create a heating system that does not require a direct connection between the conduction object and the heater, reducing the number of projections needed through the basin walls.

The detailed description set forth below in connection with the appended drawings is intended as a description of the presently preferred embodiments of pedicure chairs and heater or heaters for use with pedicure chairs provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like reference numerals are intended to indicate like or similar elements or features.

Referring now to FIG. 1, a pedicure chair 10 comprising a basin 12 for holding a water bath is shown with a user seated on a seat 18. The basin 12 is sized and shaped to receive and bathe the person's feet. Water is circulated in the basin 12 by one or more circulating pumps 100 located behind the chair cover or chair body 20 and out through covers or nozzles 102 that may be adjustable to direct the flow of water, such as to flow at or towards the person's feet. Two covers 102 are visible in FIG. 1. In some examples, each circulating pump 100 can have its pump cavity, including the pump cover and the pump impeller, located inside the interior of the basin 12 and the driving end, such as the motor, located external of the basin for driving the impeller. For example, the impeller on the inside of the basin can be rotated magnetically from a magnetic drive motor located externally of the basin. In other examples, the impeller is directly driven by a drive shaft. In some examples, one or more removable panels 22 are provided with the chair housing to provide access to the one or more circulating pumps 100 disposed under the seat 45, such as for maintenance and repairs. An induction heating system 150 can be incorporated with the pedicure chair 10 to allow water in the basin to be warmed.

As the pedicure chair 10 of the present embodiment uses induction heating, a through hole through the wall 47 of the basin 12 to mount the heating element can be omitted. In an example, induction heating from a heat source can be located externally of the basin 12 and heat a conduction object inside the basin 12. Optionally, a passage or opening can be provided through the wall 47 of the basin 12 to enable direct contact between the heat source and the conduction object with provisions for sealing the passage from leakage. However, by omitting a passage or opening between the heat source and the conduction object, the chance of water leakage from the basin is reduced. Further, the structural integrity of the chair is increased with fewer through holes or through passages formed through the wall 47 of the basin and the chair body 20.

The induction heating system 150 or heating source allows the water inside the basin to be heated and maintained at a desired temperature range to provide the user with a better experience than chairs without a similar heating source. In addition, the present induction heating system 150 can heat the pedicure bath without a passage or opening through the wall of the basin between the heat source and the induction object or workpiece. The present induction heating system 150 can also provide heat to the pedicure bath without direct contact between the heat source and the induction object.

The induction object located inside the basin 12 can heat water coming in contact with it from a first temperature and elevate the water to a second higher temperature, such as from T1 to T2 and wherein T2 is higher than T1. The heating source located external to the basin 12 comprises an inductor, which can be one or more copper coils, that is energized with AC current. Alternating current flowing through the inductor generates a magnetic field. The strength of the field varies in relation to the strength of the current passing through the coil such that heat can be controlled by controlling the current passing through the inductor. The field is concentrated in the area enclosed by the coil or adjacent by coil. The magnitude of the field can depend on the strength of the current and the number of turns in the coil. Concurrently therewith, the water can be circulated in the basin by the one or more circulating pumps 100.

As shown, the chair 10 includes a temperature selector 160 and a display 162 for monitoring the temperature of the water in the basin 12. Other switches or control mechanisms may be included, such as an on/off button and switches for controlling other functions incorporated with the chair, such as to controlling moving message elements. The temperature selector 160 may be a simple potentiometer for raising or lowering water temperature or may be a more complicated controller that allows programming and automated adjustments of water temperature, such as to elevate the temperature for 20 minutes then cool down for 5 minutes then cycle back up, etc.

The display 162 may be selectable to display various parameters such as actual water temperature, desired water temperature, elapsed time that the person has immersed their feet in the basin 12, total time, or other parameters. In another example, a second control and display panel 24 is provided nearer the basin 12 and further away from the user or customer of the pedicure chair to permit the technician or worker to control the water temperature and other parameters. The second control and display panel 24 may include a temperature selector 160*a*, a display switch 162*a*, an on/off switch, and an emergency override, as non-limiting examples.

A predetermined amount of water can be placed in the basin 12 and the water circulated within the basin by the one or more circulating pumps 100. The water can be heated to the desired temperature by means of the temperature selector 160, which can increase or decrease the current to the inductor to increase or decrease the magnetic field and hence the eddy currents and hysteresis to the workpiece located in the basin 12 that the circulated water comes in contact with to thereby control the water temperature. Additional substances such as conditioners, medicaments, fragrances, etc., may be placed in the basin with the heated water for a holistic experience.

A customer seated in the pedicure chair 10 with his feet submerged in the circulating heated water may adjust the water temperature accordingly by the temperature selector 160. The basin 12 can be emptied of water using existing means after the pedicure procedure is completed and the customer exits the chair 10. Then, the basin 12 and portions of the jet pump 100 that come in contact with the heated water can be sanitized in preparation for the next customer. For example, a new bath with a cleaner or disinfectant may be circulated through the basin to sanitize the chair for the next customer. In some examples, a thermoplastic liner may be used to line the basin. The liner can be replaced when a new or different user uses the chair. Water can be added directly into the basin with the liner in place. The pump head, impeller, and pump cover can be placed over the liner and be driven magnetically via a magnetic drive motor.

Figure 2:
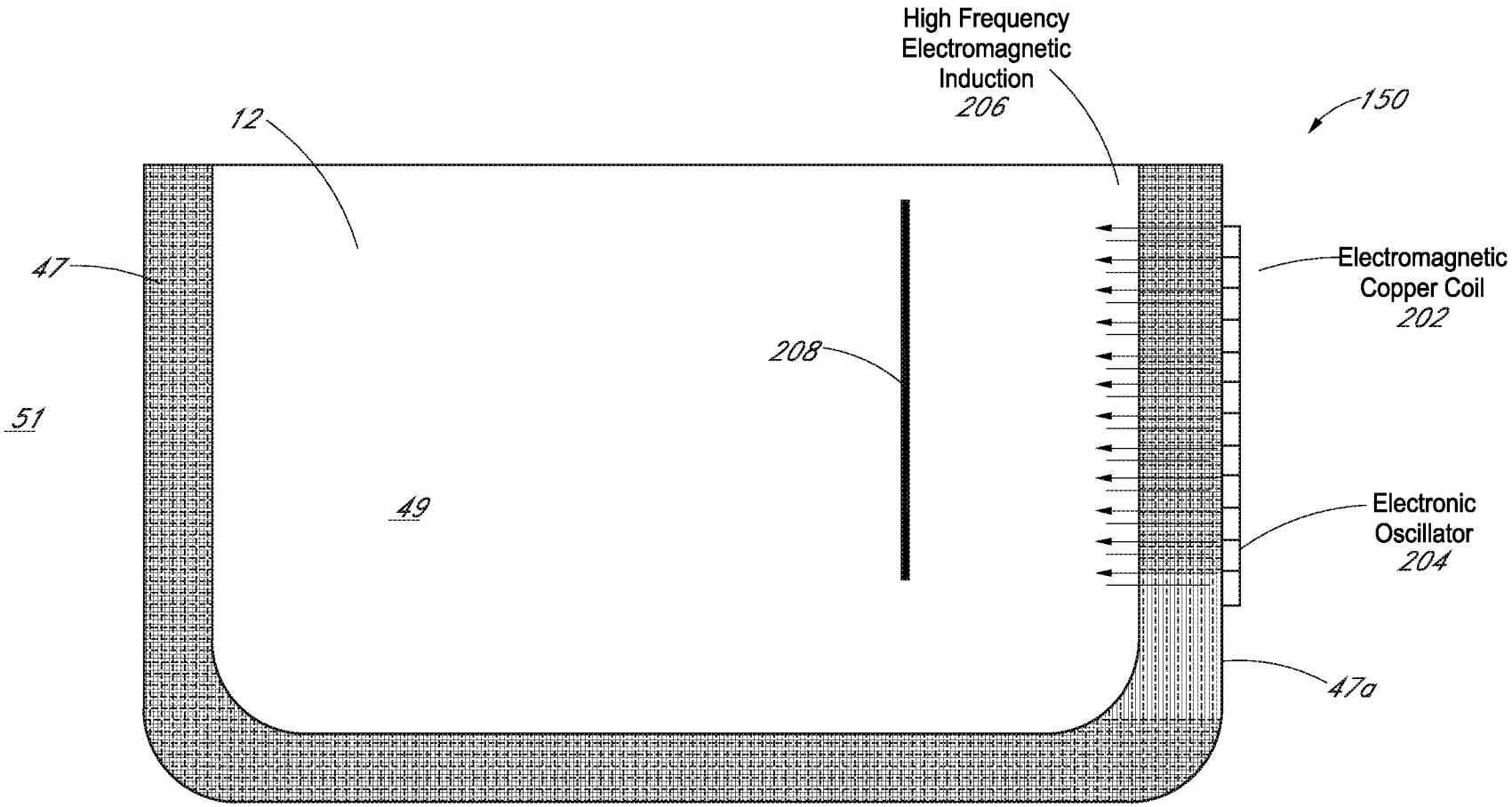
FIG. 2 is a schematic diagram of an embodiment of the induction heating system of FIG. 1.

FIG. 2 is a schematic diagram of an embodiment of the induction heating system 150 of FIG. 1 and a basin 12 with a wall structure 47. The heating system 150 comprises parts located both inside the basin 12 and outside the basin 12. For discussion purposes, the inside of the basin is called the interior space or basin interior 49 and the outside of the basin is called the exterior space 51, or externally of the basin interior. On the outside of the basin or exterior space 51 are an induction heater comprising an inductor 202, which can be one or more copper coils, and an electronic oscillator 204, such a solid state RF power supply that sends AC current through the inductor. On the inside of the basin or interior space 49 is a conducting object or workpiece 208 such as an iron plate, steel plate, or other metal object capable of being heated by induction. In practice, the workpiece 208 may be secured to the wall 47 of the basin, such as a first wall 47*a*, using fasteners, and a protective cover, such as a non-conducting insulator, covering the workpiece to avoid direct contact with the workpiece by the customer for the customer's safety. The wall structure 47 is located between the workpiece 208 and the copper coil 202.

Some embodiments may use multiple of the above elements for the heating system 150 in order to increase the heating speed of water in the basin 12. For example, there may be a first conducting object and a first induction heater on a first wall section of the basin 12, with a second conducting object and a second induction heater on a second wall section of the basin. By using multiple heating elements and/or spreading out the heating elements, the water can be heated by multiple sources to more quickly come up to a uniform temperature. Other embodiments may use different variations, such as having an extended size conducting object along one basin wall, with a first induction heater near one end with a second induction heater near the opposite end.

When in service, the oscillator 204 passes a high-frequency alternating current (AC) through the conductor 202 to generate a high frequency field. When the rapidly alternating high frequency field penetrates the conducting object 208, it generates electric currents inside the object. This current is called Eddy currents (also called a Foucault current). The Eddy currents cause the magnetic domains within the workpiece to constantly flip and cause considerable friction and heating. This type of heating is known as hysteresis.

When the Eddy currents flow through the small resistance of the metal object, it heats it up by Joule heating, making the metal object rapidly generate heat inside itself. The amount of heat generated depends on the size and turns of the electromagnetic copper coil 202, the frequency of the electromagnetic induction, and the electric current. The frequency of the current used depends on the object size, material type, coupling (between the work coil and the object to be heated) and the penetration depth. In ferromagnetic (and ferrimagnetic) materials like iron, heat may also be generated by magnetic hysteresis losses.

Typically, the basin 12 is made of a non-conducting material, such as plastic or composite, so the high frequency field can pass through the basin material with little effect to the basin. The field can then reach the conducting object 208 and cause it to heat up through high frequency electromagnetic induction 206. The conducting object 208 can then heat the water in the basin 12 that comes into contact with it. The one or more circulating pumps 100 used to circulate water in the basin can then circulate the heated water in the basin so that the water becomes more uniformly heated.

Beneficially, as the basin's structure does not need to be compromised for heating purposes (e.g., by drilling a hole or otherwise creating an opening in the basin wall to directly connect the workpiece with a heating source or power source), leaks are more easily prevented. Openings may be created in the basin wall for other reasons, such as for the circulating pump 100 or the nozzles 102 or not at all if using one or more magnetic pumps. However, reducing the number of openings in the basin 12 wall can reduce the possibility of leaks and the structural integrity of the basin.

Figure 3:
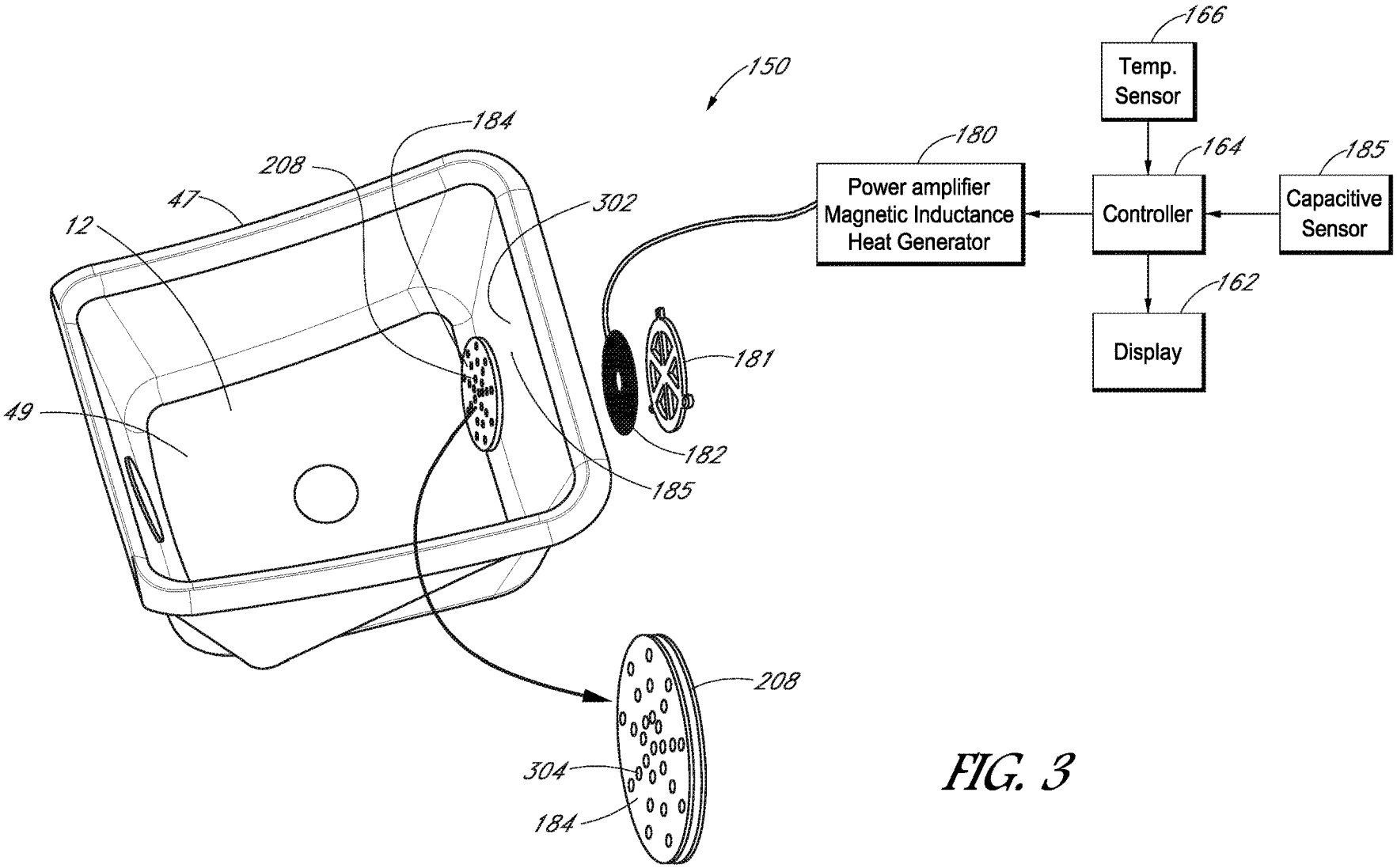
FIG. 3 illustrates a combination perspective view of the basin and induction heating system of FIG. 2 and a block diagram of the control system for the induction heating system.

FIG. 3 illustrates a combination of information including a perspective view of the basin 12 and induction heating system 150 of FIG. 2 and a block diagram of the control system for the induction heating system 150. As shown in the illustrated figure, the conducting object or workpiece 208 is attached to an interior surface or first wall section 302 of the wall 47 of the basin 12. The conducting object 208 may be attached to the basin via a variety of mechanisms, such as screws, adhesive, a built-in receptacle in the basin wall, clamping tabs projecting from the basin wall, and/or the like.

A cover 184, which can be plastic, silicone, rubber or another heat-resistant material, can be placed on top of the conducting object 208, such as on the other side of the workpiece 208 opposite the first wall 302, to prevent a user of the pedicure chair from coming into direct contact with the conducting object 208 for safety concerns. When the conducting object 208 is heated, the plastic cover 184 acts as an insulator and protects the user. In some embodiments, the plastic cover 184 comprises one or more holes 304, cutouts, or other types of openings to allow water to more easily flow through the cover 184 and into contact with the conduction object 208 to be heated. A gap can be provided between the cover and the workpiece to minimize the amount of heat transferred to the cover by the workpiece. In operation, the circulating pump 100 creates a water current in the basin that moves water in the basin through the openings 304 of the cover 184 and the gap and past the conduction object 208, allowing that water to be heated.

In the illustrated embodiment, a disk winding, conductor, or electromagnetic coil 182 and a second cover 181 are mounted on the exterior surface of the basin wall 47. As discussed above, the copper coil can generate a high frequency magnetic field to heat the conducting object 208 in the interior space 49 of the basin, on the other side of the first wall section 302. The second cover 181 can be plastic, silicone or other material. The second cover 181 may be used to insulate or isolate the conductor 182 from other components of the pedicure chair 10.

Turning to the block diagram portion of FIG. 3, the electromagnetic coil 182 can be connected (e.g., by wire) to a magnetic inductance heat generator 180, which can comprise a power amplifier and an electronic oscillator 204 (FIG. 2). Operating together, the electromagnetic coil 182 and the heat generator 180 function as the heat source for heating the workpiece inside the basin. The heat generator 180 can be connected to a controller 164. The controller 164 may be a simple combinational/sequential logic device or may be a more complicated microprocessor based circuit. Other components can also be connected to the controller 164, such as a temperature sensor 166, a display 162, and a capacitive sensor 185.

The capacitive sensor 185 can be attached to the interior surface of the first wall section 302 of the basin (as shown in the perspective view of FIG. 3) or elsewhere on the interior of the basin. The sensor 185 can be connected to the controller 164 by a wire running through or over the first wall 302. The controller 164 can then receive sensor data from the capacitive sensor 185, which data may be used to determine when to turn on/off the induction heating system 150 and/or the circulating pump 100. For example, the capacitive sensor 185 can be used to detect the fill level of the water in the basin, which could then trigger or prevent operation of the circulating pump 100.

In one embodiment, a temperature selector (FIG. 1), which may be a simple potentiometer, or may be a more complicated panel having switches for both automatic and manual temperature control, is also connected to the controller 164. The controller 164 can receive input from the temperature selector as well as status data for the pump (e.g., whether the pump has been activated or not). Based on these parameters, the controller 164 can send the appropriate electrical signals to the heating generator 180 in order to control the magnitude of the electric field to control the inductive heat in the workpiece 208 to then control the temperature of the water.

The temperature sensor 166 can be disposed in the basin 12 and feeds actual water temperature back to the controller 164. The controller 164 can then adjust the electrical current to the heating element 180 to either maintain or change the temperature of the water. The controller 164 can also send information to the display 162 so that parameters such as selected water temperature, or set point, and/or actual water temperature may be viewed. The controller 164 may also have an internal clock to display elapsed time that the jet pumps 100 have been activated for a particular customer. An audible generator may be included to notify the technician of various signals or indicators, such as when the temperature reaches a certain point, when a treatment session terminates, etc.

Figure 4:
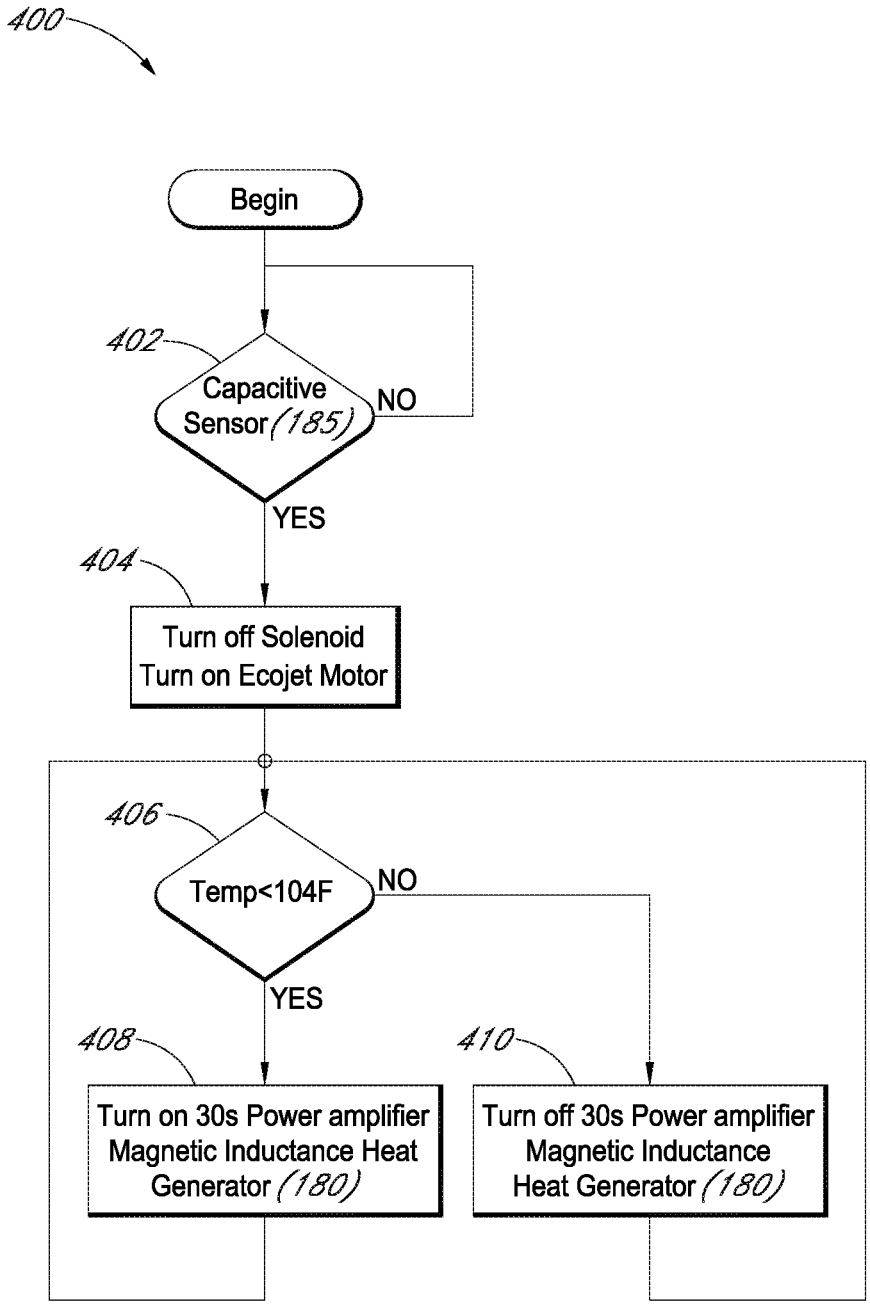
FIG. 4 illustrates a flowchart of an embodiment of a control logic process operating on the controller of FIG. 3.

FIG. 4 illustrates a flowchart of an embodiment of a control logic process 400 operating on the controller 164 of FIG. 3. Beginning at block 402, the capacitive sensor 185 determines whether the water in the basin 12 is above a predetermined threshold level. If not, the capacitive sensor 185 can repeat checking the level and the process proceeds back to block 402. Checks may happen periodically or continuously.

If the water level is above the threshold, the process proceeds to block 404. At block 404, the controller 164 turns off an optional solenoid valve. In one embodiment, the solenoid valve opens/closes a flow line to the basin 12, such as for water feed to the basin. For example, once the water flowing from an outlet port reaches a certain threshold level and triggers the capacitive sensor, the solenoid valve can close the outlet port to prevent additional water from coming in and prevent water in the basin from coming out. The controller can also turn on a motor of the circulation pump 100, such as an Ecojet™ magnetic motor, to circulate the water in the basin 164. Alternatively, the controller sends a signal to the display to ask that additional water be added before the system proceeds if no automatic fill is available.

At block 406, the temperature sensor 166 determines the temperate of the water. Based on a selected threshold, such as an exemplary 104° F., the controller turns on/off the induction heating system 150 or, specifically, a component of the system 150 such as the power amplifier/magnetic inductance heat generator 180. For example, assuming a threshold or set point of 104° F., if the actual water temperature is below 104° F., the process proceeds to block 408 and if equal or higher, proceeds to block 410. Other temperature thresholds or set points may also be used and the temperature threshold may even be set or controllable by the user.

At block 408, the controller turns on the induction heating system 150 (or component of the system) in order to heat the water in the basin 12. For example, the controller may turn on the system in 30 second increments and then proceed back to block 406 to check the temperature again. Other time intervals may also be used, such as 15, 20, 45, 60 seconds, or more. In yet other examples, the controller turns on the system for an extended period and controls the temperature by controlling the current in the inductor.

At block 410, the controller turns off the induction heating system 150 (or component of the system) for a certain interval, such as 30 seconds or the other intervals described above. The process then proceeds back to block 406 to check the temperature again. By looping back from blocks 408/410 to block 406, the controller can maintain the temperature in the basin at the desired temperature.

The process of FIG. 4 is exemplary only and that the controller may be programmed to carry out different tasks and steps. Thus, other variations are possible and contemplated. For example, the steps within the process of FIG. 4 may occur in a different order. In addition, different trigger points may be used for the decision points 402 and 408, such as higher or lower water levels or higher or lower temperatures. Other embodiments may use a simplified process, such as starting at block 406, without using input from a capacitive sensor (i.e., eliminating diamond 402 and block 404). Other embodiments may use more complex processes, such as requiring input from a user to set the target water level at block 402, the target temperature at block 406, and/or the polling frequency (e.g. 30 seconds) of the temperature sensor for maintaining the water temperature.

Figure 5:
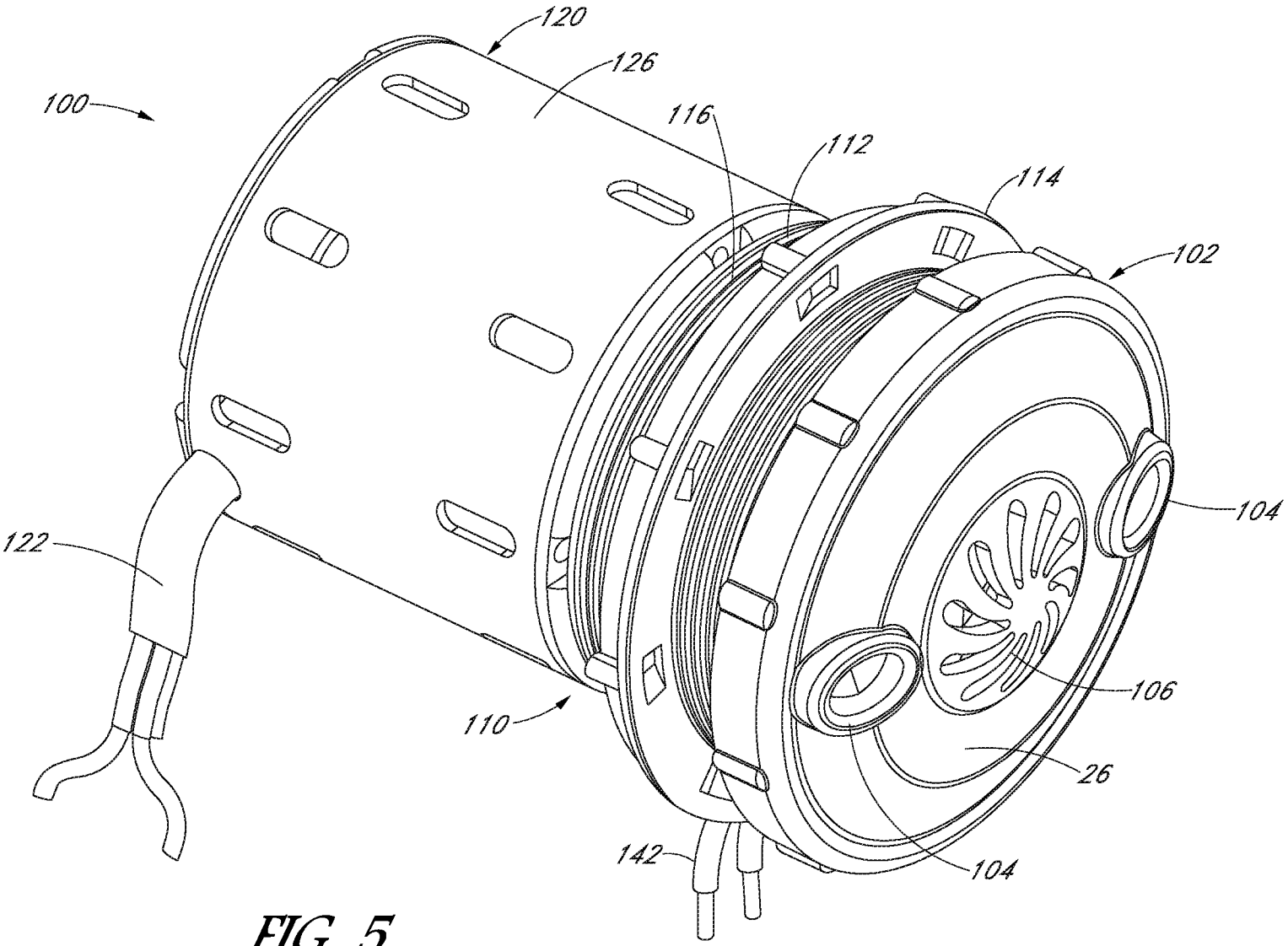
FIG. 5 illustrates an exemplary circulating pump.

FIG. 5 illustrates an exemplary circulating pump 100. The pump 100 can include a pump housing 110 having a generally cylindrical shape having external threads 112 formed thereon. The pump housing 110 may be formed with two separate housing elements or components and is connected to the motor casing 126 to form an exemplary circulating pump in accordance with aspects of the present devices, systems and methods. A first or outer housing element 114 of the pump housing 110 is threadedly or rotatably coupled to the elongated end of the second or inner housing element 116. The axial position of the first housing element 114 may be adjusted relative to the second housing element 116 by rotating the two components relative to one another. Assembly bolts (not shown) may be used to bolt the first housing element 114 to the mounting bracket mounted to the motor casing 126 to connect the pump housing 110 to the motor casing 126.

Alternatively, the first housing element 114 may attach to the mounting bracket on the motor casing using reversible detents. In accordance with aspects of the present devices, systems and methods, the second housing element 116 has an integrally formed mounting shoulder, which may instead be separately formed and subsequently coupled to the cylindrical section of the second housing element 116. The gap between the first housing element 114, which may be referred to as an adjustable mounting flange, and the mounting shoulder may be adjustable to receive different wall thicknesses therebetween, such as different basin wall thicknesses. Internally, the second housing component 116 has an integrally formed base wall having a shaft opening for receiving a drive shaft. The base wall is preferably integrally formed with the threaded cylindrical section, such as by casting or molding depending on the material used to form the pump housing 110. In another embodiment, the base wall is separately formed at subsequently attached to the cylindrical section. In some examples, the circulation pump can a magnetic pump, such as an Ecojet Magnetic Drive pump, and the impeller is rotated by a magnetic drive without directly driving the impeller with a drive shaft. For example, the cover 102 and a front housing can contain an impeller in a front drive end. The front drive end can be positioned inside the basin while the electric motor 120 is mounted externally of the basin. When the rotor of the electric motor 120 rotates, it rotates the impeller inside the front drive end located inside the basin.

The pump housing 110 may be installed to the basin 12 by placing the second housing element 116 through an opening in the basin 12 and then tightening the first housing element 114 towards the mounting shoulder with the wall surface of the basin 12 located therebetween. The cover 102 can then engage the mounting shoulder, such as by engaging removable detents on the cover and on the mounting shoulder of the housing, to cover the internal pump components, such as the impeller. Internally, where the drive shaft of the motor rotates and connects to an impeller, a stuffing box equipped with packing materials or a mechanical seal is provided to seal against water leakage via the shaft and into the motor working components, such as to the rotor and stator. Where the circulating pump is a magnetic drive pump, there is no shaft from the motor connecting the impeller.

The cover 102 has one or more intake ports or inlet openings 106, herein inlet or intake port, and one or more outlet ports 104, herein outlet or outlet port. In general, water from the basin 12 enters the circulating pump 100 via the intake port 106, is circulated within the housing 110, such as in the volute section of the housing by an impeller, and exits the circulating pump 100 via the outlet port 104. In some examples, the outlet port 104 is pivotable or maneuverable, such as with a ball and socket joint, relative to the cover surface 26 to allow directional control of the outlet from the pump.

In an alternative embodiment, the electric motor 120 may be an induction motor that has an electrically activated stator and a permanent magnet rotor. In a preferred embodiment, the stator has a well formed therein, the opening of the well being oriented toward the basin 12. The rotor has a semi-spherical shape which is received in the well in the stator. The rotor may have a central bore thereon and the well may have a post formed centrally therein such that the rotor is always properly seated in the well. The rotor preferably has a plurality of vanes formed circumferentially therein.

When operational, the motor 120 turns an impeller to create a vacuum at the inlet to draw in water. The motor can turn in either a clockwise or counter clockwise manner. Water within the basin 12 is drawn into the intake opening 106 located generally in the center of the circulating pump cover 102 by rotation of the impeller 130. When discharging, the outlet ports 104 act as a nozzle to forcefully direct the water into the basin 12 producing agitation, circulation, and a whirlpool effect of the water within the basin 12.

Thus, an aspect of the present disclosure may be understood to include devices, systems, and methods comprising an induction heating system sized and shaped for use with a pedicure chair, such as for mounting to wall surface(s) of a basin of the pedicure chair. Another aspect of the present disclosure is a combination pedicure chair comprising a basin having an induction system mounted thereto. The pedicure chair can further include one or more circulation pumps.

A further aspect of the present disclosure is a method for heating water in a pedicure chair. In one example, the method comprises attaching an induction heater to the exterior of a basin of the pedicure chair and a conduction object to the interior of the pedicure chair, with the induction heater and the conduction object separated by a solid portion of the basin wall. A controller connected to the induction heater is configured to turn on/off the induction heater based on various data inputs, such as temperature and/or water fill level, in order to maintain the temperature in the basin at a desired temperature.

Although limited embodiments have been specifically described and illustrated herein, many modifications and variations will be apparent to those skilled in the art. Accordingly, it is to be understood that the apparatus constructed according to principles of the disclosed device, system, and method may be embodied other than as specifically described herein. The disclosure is also defined in the following claims.

What is claimed is:

1. An induction heating system for a pedicure chair, comprising:

a basin located below a seat of the pedicure chair, said basin having a plurality of walls defining a basin interior, said plurality of walls comprising a first wall, having a first wall exterior and a first wall interior, and a bottom wall, having a bottom wall exterior and a bottom wall interior, the first wall and a second wall defining at least part of a sidewall of the basin;

a conducting object located in the basin interior between a non-conducting cover and the first wall interior;

an induction heater secured to the first wall exterior; and a controller configured to turn on or off the induction heater;

a circulating pump mounted to the second wall;

wherein the conducting object is separated from the induction heater by a solid portion of the first wall;

wherein the induction heater is configured to generate a high frequency field that passes through the solid portion of the first wall to cause the conducting object to generate heat.

2. The induction heating system of claim 1, wherein the induction heater comprises an electromagnet coil and an electronic oscillator and wherein the conducting object has a side perimeter that is exposed inside the basin.

3. The induction heating system of claim 1, wherein the conducting object is an iron plate.

4. The induction heating system of claim 1, wherein the non-conducting cover is a plastic heat-resistant cover.

5. The induction heating system of claim 4, wherein the non-conducting cover is a first non-conducting cover and has a generally round disc-shape cover and wherein a second non-conducting cover is mounted over the induction heater.

6. The induction heating system of claim 1, further comprising a capacitive sensor electrically connected to the controller.

7. The induction heating system of claim 6, wherein the controller is configured to turn on the circulating pump based at least partly on a water level detected by the capacitive sensor.

8. The induction heating system of claim 1, further comprising a temperature sensor electrically connected to the controller.

9. The induction heating system of claim 8, wherein the controller is configured to turn on the induction heater based at least partly on the temperature sensor.

10. A pedicure chair comprising:

a basin located below a seat of the pedicure chair, said basin comprising an exterior surface and an interior surface defining a basin interior for holding water, the basin having a first wall, having a first wall exterior and a first wall interior, and a bottom wall, having a bottom wall exterior and a bottom wall interior, the first wall defining at least part of a sidewall of the basin;

a circulating pump comprising a motor and a cover coupled to the sidewall of the basin, wherein the motor is disposed on the exterior surface of the basin and the cover is disposed on the interior surface of the basin;

a conducting object located in the basin interior and secured between a non-conducting cover and the first wall interior;

an induction heater located externally of the first wall exterior; and a controller electrically coupled to the induction heater and configured to turn on or off the induction heater;

wherein the conducting object is separated from the induction heater by a solid portion of the first wall;

wherein the induction heater is configured to generate a high frequency field that passes through the solid portion of the first wall and to cause the conducting object to generate heat; and wherein conducting object has a perimeter and the non-conducting cover has a perimeter and wherein the two perimeters are substantially equal.

11. The pedicure chair of claim 10, wherein the induction heater comprises an electromagnet coil and an electronic oscillator.

12. The pedicure chair of claim 10, wherein the conducting object is an iron plate and the perimeter of the conducting object is round.

13. The pedicure chair of claim 10, wherein the non-conducting cover is round and made from a plastic material.

14. The pedicure chair of claim 13, wherein the non-conducting cover is a first non-conducting cover and wherein a second non-conducting cover is mounted over the induction heater.

15. The pedicure chair of claim 10, further comprising a capacitive sensor electrically connected to the controller.

16. The pedicure chair of claim 15, wherein the controller is configured to turn on the circulating pump based at least partly on a water level detected by the capacitive sensor.

17. The pedicure chair of claim 10, further comprising a temperature sensor electrically connected to the controller.

18. The pedicure chair of claim 17, wherein the controller is configured to turn on the induction heater based at least partly on the temperature sensor.

19. A method for mounting an induction heating system to a pedicure chair, the method comprising:

providing a basin below a seat of a pedicure chair, said basin having a plurality of walls defining a basin interior, said plurality of walls comprising a first wall, having a first wall exterior and a first wall interior, and a bottom wall, having a bottom wall exterior and a bottom wall interior, the first wall and a second wall defining at least part of a sidewall of the basin;

mounting a conducting object between a non-conducting cover and the first wall interior of the basin;

attaching an induction heater externally of the first wall exterior;

attaching a circulating pump to the second wall;

electronically connecting the induction heater to a controller, said controller configured to turn on or off the induction heater; and wherein the conducting object is separated from the induction heater by a solid portion of the first wall.

20. The method of claim 19, further comprising sending a temperature signal to the controller to turn on the induction heater.

* * * * *